US005279284A

United States Patent [19]

Fenn

[11] Patent Number: 5,279,284

[45] Date of Patent: Jan. 18, 1994

[54] SKIN STIMULATION DEVICE

[75] Inventor: Gordon W. Fenn, Dundee, Mich.

[73] Assignee: Frontier, Inc., Dundee, Mich.

[21] Appl. No.: 775,729

[22] Filed: Oct. 11, 1991

[51] Int. Cl.[5] ..... A61H 23/00

[52] U.S. Cl. ..... 128/55; 128/44

[58] Field of Search ..... 128/44, 51-55; 606/201, 204; 200/DIG. 2

[56] References Cited

U.S. PATENT DOCUMENTS

| | | | |
|---|---|---|---|
| 3,944,843 | 3/1976 | Vaz Martins | 200/DIG. 2 X |
| 4,069,659 | 1/1978 | Harris et al. | 200/DIG. 2 X |
| 4,069,816 | 1/1978 | Yamamura | 128/55 X |
| 4,088,128 | 5/1978 | Mabuchi | 128/55 X |
| 4,549,535 | 10/1985 | Wing | 128/55 |
| 4,566,442 | 1/1986 | Mabuchi et al. | 128/55 X |
| 4,779,615 | 10/1988 | Frazier | 128/54 X |
| 4,827,914 | 5/1989 | Kamazawa | 128/55 X |
| 4,991,568 | 2/1991 | Lin | 128/52 X |
| 5,088,474 | 2/1992 | Mabuchi et al. | 128/52 |
| 5,092,316 | 3/1992 | Taylor et al. | 128/53 X |

*Primary Examiner*—Robert A. Hafer
*Assistant Examiner*—Brian E. Hanlon

[57] ABSTRACT

A device for stimulating the skin of an individual by an applicator which has a head containing solenoid-operated plungers. The solenoids' windings are duty-cycle operated by associated oscillator/driver circuits to cause their plungers to repeatedly impact the skin with relatively small force impulses so that the skin as distinguished from muscles is affected. By repeated minute stimulation of the skin in the vicinity of pain, a hypnotic type of effect that can alleviate pain symptoms has been found to occur. The solenoids are operated in particular modes which are other than one in which all solenoids are simultaneously energized and de-energized in unison.

6 Claims, 2 Drawing Sheets

SKIN STIMULATION DEVICE

FIELD OF THE INVENTION

This invention relates to a device for non-invasively stimulating the skin of an individual for therapeutic purposes, and in particular to a device of that character which, although electrically operated, acts mechanically, rather than electrically, on the skin.

BACKGROUND AND SUMMARY OF THE INVENTION

Numerous devices for the non-invasive therapeutic treatment of the human body have been proposed. Many of these are of the class that may be generally referred to as massaging devices or vibrators which act through the skin on subcutaneous body structure, for example muscles and joints, with the objective of promoting comfort, relaxation, and/or relief for the individual. This general technical field also contains devices that are specifically for stimulating the skin.

Examples of known devices are represented by U.S. Pat. Nos. 2,479,253; 3,968,789; 4,085,738; 4,777,943; and 4,788,968 which developed in preliminary novelty searching conducted in connection with the present invention.

The present invention relates to a new and unique device for therapeutic treatment of the human body which performs in a manner unlike any other of which the inventor is aware. The invention involves the discovery that it is possible to obtain some form of pain relief by the stimulation of the skin using particular methodologies. While reasons for this effect are presently not fully known to the inventor, it is the inventor's belief that these particular methodologies induce a physiological response that masks at least to some extent the pain for which relief is sought. And although the inventor's experimental testing to date has involved only a limited number of subjects, the results obtained suggest that the general population can in many cases obtain a benefit from the invention.

In a general way, the methodologies involving principles of the invention comprise the non-invasive stimulation of a zone of the skin by repetitively impacting it with the rounded tip ends of small solenoid-operated plungers that are operated in a pattern which is other than the simultaneous energization and de-energization of all of the plungers. Rather, the plungers are selectively energized and de-energized according to certain patterns, which will be subsequently described in detail. By subjecting a treatment zone to such procedures for a certain limited amount of time, the inventor has found that an individual may obtain a certain amount of relief during, and even for an extended time beyond termination of, the treatment. While it is believed that devices which embody the principles of the invention can be useful to many individuals who seek relief from certain types of discomfort or pain, such devices may be used for relaxation or skin stimulation purposes alone in the absence of underlying discomfort.

Devices embodying the principles of the invention are well suited for mass-production fabrication as so to enable them to be made available to the public at reasonable cost. The non-invasive character of the devices is calculated to promote their acceptance by consumers for personal use outside of a professional treatment environment although it is expected that treating professionals will find such devices to be beneficial for certain forms of patient treatment.

Principles of the invention relating to its constructional as well as its methodological aspects will be seen by the reader in the ensuing detailed description of a presently preferred embodiment. The disclosure is accompanied by drawings which illustrate a presently preferred embodiment according to the best mode contemplated at this time for carrying out the invention. In the drawing figures like reference numerals are used to designate like parts.

DESCRIPTION OF THE PREFERRED EMBODIMENT

Figure 1:
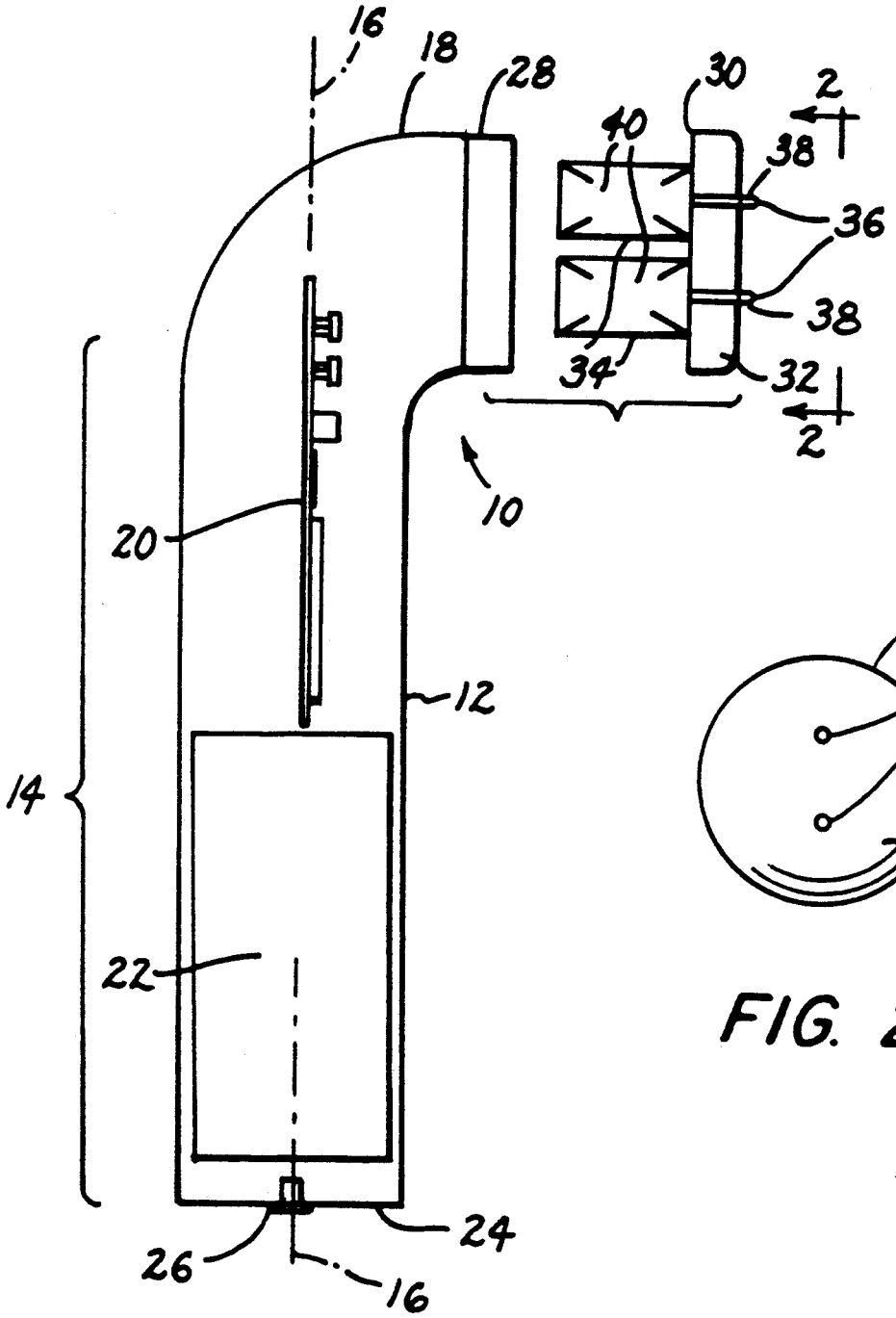
FIG. 1 is a semi-schematic side elevational view, partly exploded and sectioned away, of a first embodiment of device according to the inventive principles.
Figure 2:
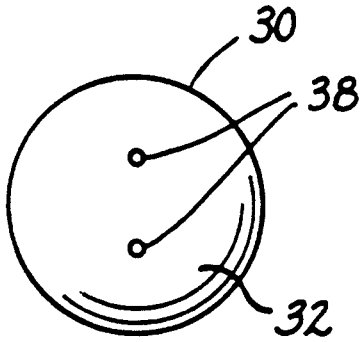
FIG. 2 is a view in the direction of arrows 2—2 in FIG. 1.
Figure 3:
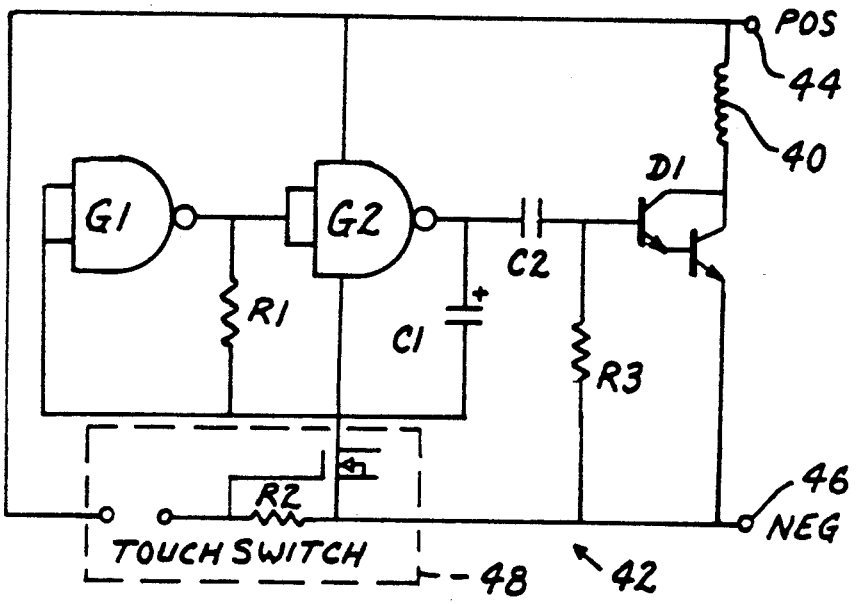
FIG. 3 is an electric schematic diagram of a portion of the electric circuitry of the device.

Details of a first embodiment of device 10 are shown in FIGS. 1, 2, and 3. This embodiment is a self-contained, hand-held, portable, battery-operated applicator. It comprises a housing 12 in the form of an electrically conductive tube having a ninety degree bend, or elbow, nearer one end so as to divide the housing lengthwise into a proximal and longer straight handgrip section 14, which is coincident with the lengthwise axis 16 of the device, and a distal and shorter straight section 18 whose axis is at ninety degrees to that of section 14.

An electric circuit board assembly 20 is mounted within housing 12 intermediate the ends thereof by suitable mounting means (not shown in FIG. 1). A rechargeable D.C. battery 22 is disposed within section 14 proximal to electric circuit board assembly 20 and is electrically connected to electric circuitry on it. The proximal end of housing 12 is closed by a removable end closure cap 24 which contains an externally accessible re-charging socket 26 that is connected within the housing to the circuitry on the circuit board assembly for enabling the battery to be re-charged by connecting the socket to a battery re-charger.

Section 18 terminates distally in a circular opening to which a mating circular insulator ring 28 is joined. A head assembly 30 closes the open end of ring 28 in the completed device, and it is to be understood that the head assembly is shown separated (exploded away) from the rest of the device in FIG. 1 for illustrative purposes.

Head assembly comprises an electrically conductive head member 32 which is of circular shape and on which two solenoids 34 are mounted. Head member 32 removably assembles to the device to close the open end of ring 28 while allowing only the rounded tip ends 36 of the plungers 38 of the solenoids to project exteriorly from the head. The axes of the plungers are one hundred eighty degrees apart from each other and at equal radial distances from the axis of the head. Wires from the two solenoids 34 are electrically connected to the circuitry on the circuit board assembly.

Each solenoid 34 comprises a conventional coil winding 40, and with the winding de-energized, the solenoid's plunger 38 is biased to a rest condition. When the winding is energized, the plunger is displaced axially a short distance from its rest position. This displacement distance is the plunger's stroke. When the winding ceases to be energized, the plunger is return stroked to its rest position.

Circuit board assembly 20 contains two oscillator/-driver circuits 42, one for each solenoid 34. FIG. 3 shows one of the oscillator/driver circuits, and it is understood that there is a like circuit for the other solenoid. Circuit 42 has positive and negative input terminals 44, 46 respectively for connecting the circuitry on the circuit board assembly with battery 22. The oscillator portion of the circuit comprises two gates G1, G2, a resistor R1, and a capacitor C1 connected as shown in association with a touch switch 48. Closure of the touch switch starts the oscillator, and opening of the switch turns the oscillator off. The oscillator output is coupled through an RC coupling circuit R3, C2 to the base-emitter of an NPN type driver transistor D1. Winding 40 of the solenoid is connected between the collector of transistor D1 and positive terminal 44. Negative terminal 46 is connected to the emitter of transistor D1. When the touch switch is closed to operate the oscillator, the solenoid winding is repetitively energized and de-energized to cause the plunger to be stroked back and forth at the oscillator frequency.

Touch switch 48 is common to the oscillator portions of both circuits 42 so that when the touch switch is closed, both plungers are stroked. Due to component tolerances, the phases and frequencies of the strokes of the plungers will not be identical, and hence the two plungers are said to be asynchronously operating.

Device 10 is used by a person grasping section 14 and placing head assembly 30 against an area of his or her skin which is to be subjected to treatment. The placement of the head assembly against the skin will create conductive contact between head member 32 and the skin while also placing the rounded plunger tip ends 36 against the skin. The contact between the skin and head member 32 and the manual contact with housing 12 are sensed by touch switch 48, and this results in the closure of the touch switch to start the plungers stroking. Thus, sensing terminals of the touch switch are respectively electrically connected to housing 12 and head member 32 respectively, and the touch switch is itself mounted on circuit board assembly 20.

The stroking of the plungers creates repeated mechanical impacts with the skin, and typically the person will manipulate the head over an area of the skin so that the repeated impacts are felt over that area. The application of a treatment procedure for a certain amount of time creates a physiological response that has been found at least in certain cases to mask pain. Thus the device of the present invention may be found by individuals to promote some form of pain relief. Even if pain relief is not an objective, the device may be used for other purposes, such as therapeutic relaxation.

The inventor's studies to date have been limited to certain examples of plunger stroke, plunger diameter, and stroke frequency since the number of combinations of these parameters is quite large. However, it is believed that strokes within a range of 0.020 inch to 0.100 inch, plunger diameters within a range of 0.030 inch to 0.200 inch, and stroking frequencies with a range of 2 hertz to 1,000 hertz are capable of producing desired effects.

Figure 5:
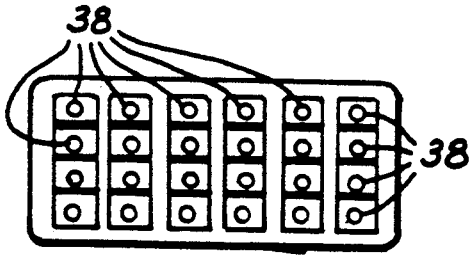
FIG. 5 is a view in the direction of arrows 5—5 in FIG. 4.
Figure 4:
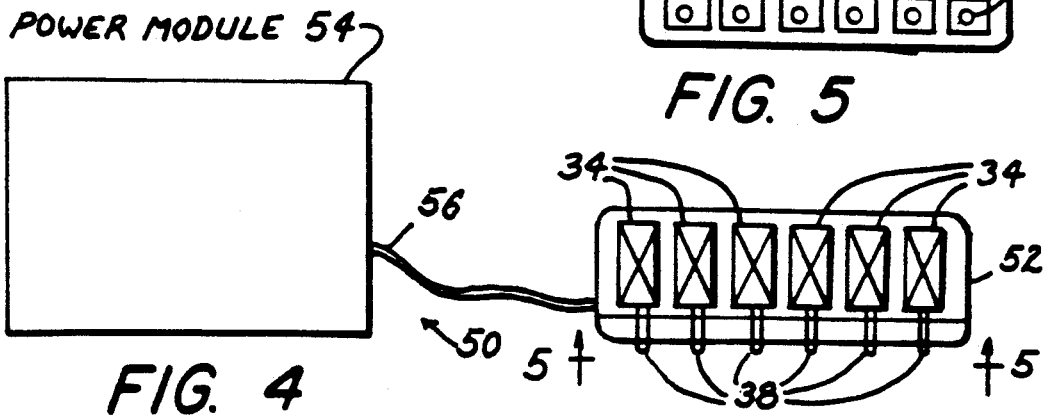
FIG. 4 is a semi-schematic side elevational view partly sectioned away of a second embodiment.

The example of device 10 represents a product that is intended principally for personal use by individuals. Other larger embodiments are contemplated and are suitable for use by one individual who renders treatment to another. An example of such a device 50 is shown in FIGS. 4 and 5.

Device 50 comprises an applicator 52 that is connected to a power module 54 by a cable 56 that contains a number of electrical wires extending between the two. The applicator is intended to by grasped by a person rendering the treatment to a person being treated. It is applied to whatever area or areas are to receive treatment.

Applicator 52 comprises a number of individual solenoids 34 which are arranged in a rectangular m by n array. Each solenoid is connected via wiring in cable 56 with its own oscillator/driver circuit 42 in power module 54. The power module may be connected to an electrical outlet to receive electric power and contains suitable means for converting the usual A.C. power to the D.C. levels for operating the solenoids and the electrical circuitry. It also includes an on-off switch in substitution of the touch switch of the first embodiment.

As in the first embodiment, device 50 may operate its solenoids in asynchronous manner. However, given an $m \times n$ array of the solenoids, different modes of operation are possible. One mode comprises operating the m rows only one row at a time while having the individual solenoids in the operating row operating asynchronously. The only one row at a time operation is conducted by operating the individual rows according to a particular pattern, such as operating the rows consecutively sequence and after all rows have been operated in this manner, repeating the sequence beginning with the first row. In this way a uni-directional sweeping of a skin treatment zone may be performed. Alternatively, the only one row at a time operation may be conducted by operating the rows consecutively in sequence and after the last row has been operated, reversing the sequence. In this way a back and forth bi-directional sweeping of a skin treatment zone may be performed. If stroking is to be done on a row by row basis, then it may be unnecessary that each solenoid have its own individual oscillator/driver circuit. For example, all solenoids in a single row may share a common oscillator driver so that within the individual row, the solenoids are operated substantially in synchronism.

In accordance with the inventive aspects, the stimulation by an individual plunger is small so that the skin as distinguished from muscles is affected. For this reason the inventive principles are quite separate and distinct from principles of massage, and the devices that have been disclosed herein are not considered body massagers. By repeated minute stimulation in the vicinity of pain, a hypnotic type of effect seems to occur which has been found to alleviate pain symptoms after an application of perhaps two to three minutes. This affect has also been found to prolong itself for extended times after the treatment application, even as much as several hours. Accordingly, it is believed that this invention represents a meaningful contribution to the technical field which is capable of providing therapeutic benefit to many individuals.

An example of a specific solenoid 34 that is suitable for use in the practice of the invention comprises 598 turns of 36.0 gage wire having a resistance of 15.8 ohms.

The overall length of the winding is about one-half inch. The coil may be energized at a 10% to 20% duty-cycle using an approximate 9.6 volt D.C. source.

Although it is not shown in the drawing, a removable plastic cap is fitted over the head end of the device when the device is not in use so that external electric continuity between the conductive head and the conductive housing, and consequent running of the device, is prohibited. When the device is to be used, the tubular cup-shaped cap is removed so that external conductivity between the head and housing once again is possible.

While a presently preferred embodiment of the invention has been illustrated and described, it should be appreciated that the principles of the invention may be practiced by any specific means and methods that fall within the scope of the following claims.

What is claimed as the invention is:

1. A device for stimulating a zone of human skin comprising an applicator having a head for confronting the skin, plural solenoids disposed on said applicator in an array in the vicinity of said head, each of said solenoids having a plunger that comprises a tip end which projects away from said head for imparting stimulus to the skin by repetitively impacting the skin in response to the repetitive energization and de-energization of the plunger's solenoid, said device comprising an electric circuit board assembly containing electric circuitry thereon for repetitively energizing and de-energizing each of said solenoids, means for supplying electric power to said electric circuitry, and said electric circuitry comprising plural solenoid drivers each of which is individual to an individual associated one of said solenoids for selectively energizing and de-energizing the associated solenoid independently of the energization and de-energization of the other solenoids by their solenoid drivers, and means for operating said solenoid drivers in at least one mode of operation which is other than one in which all solenoids are simultaneously energized and de-energized in unison, and further containing D.C. battery means providing a self-contained electric power supply for operating said solenoids via said electric circuitry, said applicator comprising a hand-held housing containing said head, said solenoids, said electric circuit board assembly, and said D.C. battery means, and in which said head and housing are both electrical conductors that are electrically separated by an insulator, and said device contains touch switch means that is connected respectively to said housing and to said head and that is actuated by a conductive path through a user's body when the user grasps the housing and places a portion of the head in contact with the skin, and in which said touch switch means is operatively connected with said electric circuitry such that when said touch switch means is so actuated, said solenoid drivers are operated by said electric circuitry.

2. A device as set forth in claim 1 in which said head and said housing are arranged such that said head faces laterally of a lengthwise axis of said housing.

3. A device as set forth in claim 1 in which said plungers each comprises a cylinder having a diameter within the range of 0.030 inch to 0.200 inch and a stroke within the range of 0.020 inch to 0.100 inch, and in which said solenoid drivers cause said plungers to reciprocate at a frequency within the range of 2 hertz to 1,000 hertz.

4. A device for stimulating a zone of human skin comprising an applicator having a head for confronting the skin, plural solenoids disposed on said applicator in an array in the vicinity of said head, each of said solenoids having a plunger that comprises a tip end which projects away from said head for imparting stimulus to the skin by repetitively impacting the skin in response to the repetitive energization and de-energization of the plunger's solenoid, said device comprising an electric circuit board assembly containing electric circuitry thereon for repetitively energizing and de-energizing each of said solenoids, means for supplying electric power to said electric circuitry, and said electric circuitry comprising plural solenoid drivers each of which is individual to an individual associated group of at least one of said solenoids for selectively energizing and de-energizing the associated group independently of the energization and de-energization of the other groups by their solenoid drivers, and means for operating said solenoid drivers in at least one mode of operation which is other than one in which all solenoids are simultaneously energized and de-energized in unison, said device containing D.C. battery means providing a self-contained electric power supply for operating said solenoids via said electric circuitry, said applicator comprising a hand-held housing containing said head, said solenoids, said electric circuit board assembly, and said D.C. battery means, in which said head and housing are both electrical conductors that are electrically separated by an insulator, and said device contains touch switch means that is connected respectively to said housing and to said head and that is actuated by a conductive path through a user's body when the user grasps the housing and places a portion of the head in contact with the skin, and in which said touch switch means is operatively connected with said electric circuitry such that when said touch switch means is so actuated, said solenoid drivers are operated by said electric circuitry.

5. A device as set forth in claim 4 in which said head and said housing are arranged such that said head faces laterally of a lengthwise axis of said housing.

6. A device as set forth in claim 4 in which said plungers each comprises a cylinder having a diameter within the range of 0.030 inch to 0.200 inch and a stroke within the range of 0.020 inch to 0.100 inch, and in which said solenoid drivers cause said plungers to reciprocate at a frequency within the range of 2 hertz to 1,000 hertz.

* * * * *